US007607277B2

(12) United States Patent
Tsuchiya et al.

(10) Patent No.: US 7,607,277 B2
(45) Date of Patent: Oct. 27, 2009

(54) WORK PIECE WRAPPING APPARATUS

(75) Inventors: Akihiro Tsuchiya, Nagareyama (JP); Toshio Yoshinari, Nagareyama (JP)

(73) Assignee: Tokyo Automatic Machinery Works, Ltd., Tokyo (JP)

( * ) Notice: Subject to any disclaimer, the term of this patent is extended or adjusted under 35 U.S.C. 154(b) by 343 days.

(21) Appl. No.: 10/598,668

(22) PCT Filed: Mar. 12, 2004

(86) PCT No.: PCT/JP2004/003314

§ 371 (c)(1),
(2), (4) Date: Sep. 7, 2006

(87) PCT Pub. No.: WO2005/087593

PCT Pub. Date: Nov. 22, 2005

(65) Prior Publication Data

US 2008/0209856 A1 Sep. 4, 2008

(51) Int. Cl.
*B65B 49/00* (2006.01)

(52) U.S. Cl. ..... 53/230; 53/223

(58) Field of Classification Search ..... 53/220, 53/223, 224, 228, 230, 231, 232, 465, 466
See application file for complete search history.

(56) References Cited

U.S. PATENT DOCUMENTS

| | | | | | |
|---|---|---|---|---|---|
| 2,098,245 | A | * | 11/1937 | Jackson | 53/223 |
| 2,155,398 | A | * | 4/1939 | Bronander | 53/223 |
| 2,162,773 | A | * | 6/1939 | Bronander | 53/223 |
| 2,196,910 | A | * | 4/1940 | Delamere | 53/223 |
| 2,597,877 | A | * | 5/1952 | Le Clair | 26/88 |
| 2,609,646 | A | * | 9/1952 | Total | 53/223 |
| 2,930,173 | A | * | 3/1960 | Labine | 53/230 |
| 3,385,026 | A | * | 5/1968 | Schmermund | 53/228 |
| 3,956,790 | A | * | 5/1976 | Ishiwata et al. | 15/302 |
| 4,231,210 | A | * | 11/1980 | Nagode | 53/397 |
| 4,385,479 | A | * | 5/1983 | Focke | 53/228 |
| 4,495,746 | A | * | 1/1985 | Focke et al. | 53/389.3 |
| 4,999,967 | A | | 3/1991 | Hoffmann | |
| 5,099,979 | A | * | 3/1992 | Kehrel | 198/345.1 |
| 5,245,503 | A | * | 9/1993 | Rodrigo | 361/231 |
| 5,782,063 | A | * | 7/1998 | Boriani et al. | 53/223 |
| 6,023,911 | A | * | 2/2000 | Elvers et al. | 53/228 |
| 6,766,625 | B2 | * | 7/2004 | Cinotti | 53/230 |
| 2003/0167736 | A1 | * | 9/2003 | Cinotti | 53/230 |

FOREIGN PATENT DOCUMENTS

| | | |
|---|---|---|
| JP | 2723581 | 11/1997 |
| JP | 10-59312 | 3/1998 |
| JP | 10-194219 | 7/1998 |
| JP | 2003-095209 | 4/2003 |

* cited by examiner

*Primary Examiner*—Louis K Huynh
(74) *Attorney, Agent, or Firm*—K&L Gates LLP

(57) ABSTRACT

A work piece wrapping apparatus for wrapping a work piece being transported along a transporting path of the work piece is provided with: a wrapping sheet supply device that supplies the wrapping sheet onto a transporting path of the wrapping sheet intersecting the transporting path of the work piece; a delivery guide device that causes the work piece to be wrapped by pushing the wrapping sheet with the work piece; and a spreading guide provided on the periphery surface of a transit aperture of the delivery guide device, and whose center area in the transverse direction protrudes toward the rear in a transporting direction of the work piece so as to gradually spread the wrapping sheet out from a center area in the transverse direction of the work piece towards both edges thereof with the work piece advances through the transit aperture.

16 Claims, 9 Drawing Sheets

WORK PIECE WRAPPING APPARATUS

The present invention relates to a wrapping apparatus that wraps work pieces such as various products, and in particular, to a wrapping apparatus that wraps a wrapping sheet such that it contacts closely to a work piece.

BACKGROUND

Generally, among wrapping apparatuses that are used to automatically wrap a wrapping sheet such as a film around a work piece, a wrapping apparatus is known in which the film used for wrapping is positioned in a direction orthogonal to the transporting direction of the work piece, and by transporting the work piece such that it presses against the film, the work becomes covered by the film. The apparatuses described in Patent Documents 1 and 2 below are examples of this type of wrapping apparatus.

PATENT DOCUMENT 1: Japanese Patent No. 2723581

PATENT DOCUMENT 2: Japanese Patent Application, First Publication No. H10-194219

In the wrapping apparatus described in Patent Document 1, in order to feed a wrapped work piece to the interior of a pocket of a pocket conveyor, a nozzle having an aperture whose dimensions match the thickness of the work piece is placed so as to face the opening of the pocket, and the film is positioned in a direction that is orthogonal to the transporting direction of the work piece to the rear in the transporting direction of the work piece. By then pressing the work piece against the film and making them pass through the nozzle, the film becomes wrapped around so as to cover the work piece and the work piece is then placed inside a pocket.

In the wrapping apparatus described in Patent Document 2, a pair of floating rollers that are spaced the same distance apart as the pocket boxes are placed in the vicinity of openings in pocket boxes that are used to house work pieces that have been wrapped, and a film is positioned in a vertical direction in the same manner as in Patent Document 1 to the rear in the transporting direction of the work piece. By transporting the work piece in a horizontal direction so that it presses against the film and so that the two are made to pass between the floating rollers, the work piece is packaged in a wrapped state and is placed inside a pocket box.

However, in the wrapping apparatuses described in Patent Documents 1 and 2, the work piece passes through the inside of the nozzle and the pair of floating rollers while the film is being wrapped, and because the space between the nozzle and the floating rollers is a fixed size that is equal to the thickness of the work piece, if there are any irregularities in the size of the work piece, then gaps may remain between the work piece and the film causing defects such as residual air and wrinkling to be generated. Moreover, if there are any bumps and indentations in the surface of the work piece, then because gaps remain between the film and the work piece, in the same way, these cause residual air and wrinkling. Because of this, these wrapping apparatuses have the drawback that they do not make it possible to achieve tight wrapping of a work piece without any wrinkling being generated and without any residual air being left behind.

The present invention was conceived in view of the above described circumstances, and it is an object thereof to provide a wrapping apparatus that makes it possible to perform wrapping in which there is no wrinkling and in which no air remains between the work piece and wrapping sheet even if there are irregularities in the dimensions of the work piece or if there is unevenness in the surface of the work piece.

SUMMARY

The apparatus of the present invention is a work piece wrapping apparatus for wrapping a work piece being transported along a transporting path in a wrapping sheet, and includes: a wrapping sheet supply device that supplies the wrapping sheet onto the transporting path; a delivery guide device that causes the wrapping sheet to be wrapped by pushing the wrapping sheet on the transporting path so as to cause the work piece to pass through a transit aperture that is provided between a pair of delivery guides; and a spreading guide provided in the transit aperture of the delivery guide device, and gradually spreads the wrapping sheet out from a center area in the transverse direction of the wrapping sheet towards both edges thereof with the work piece advances through the transit aperture.

According to the present invention, when a wrapping sheet is pressed by a work piece being transported along a transporting path so that the wrapping sheet is made to pass through a transit aperture between delivery guide portions, by using a spreading guide to gradually spread out the wrapping sheet from a center area in the transverse direction of the surface of the work piece in the direction of the two edges thereof, the work piece can be wrapped with any wrinkling and the like in the center of the wrapping sheet pushed outwards to the outer sides.

Note that it is preferable for the spreading guide to be formed such that the center area in the transverse direction thereof protrudes beyond the two end sides thereof. It is also possible for the spreading guide to be formed substantially in a dovetail shape that protrudes in the transporting direction of the work piece. It is also not essential for the center area to be in the center in the transverse direction and it may also be offset to one side in the transverse direction.

Moreover, it is preferable for an elastic component to be provided in the delivery guide portion that adjusts the distance between the two delivery guide portions when it is pressed by the work piece during the transit of the work piece.

Smoothing pads that cause the wrapping sheet to contact tightly to a surface of the work piece are provided in the transit aperture of the delivery guide device. These smoothing pads are formed by a plurality of bristles and a space between a pair of the smoothing pads that face each other across the transit aperture is set so as to be less than the thickness of the work piece.

Even if there are bumps and indentations in the surface of the work piece that is passing through the transit aperture in the delivery guide portion, because the wrapping sheet is made to tightly contact to the surface of the work piece by the smoothing pads, any gaps between the wrapping sheet and the surface of the work piece are eliminated and any residual air can be reliably expelled. Accordingly, tight wrapping with no wrinkling can be achieved. In particular, because the large number of bristles is able to deform individually, each bristle deforms individually so as to conform to and follow the shape of the bumps and indentations in the surface of the work piece. Accordingly, any residual air can be reliably pushed out.

It is also preferable for a correction guide that elastically sandwiches the work piece to be provided upstream side from the delivery guide device in the transporting direction of the work piece.

By using a correction guide to press and sandwich a work piece between the correction guide and the transporting path, the work piece can be supplied to the delivery guide device with any crookedness and warping and the like in the work piece having been corrected.

Furthermore, it is also possible for a plurality of suction belts that feed it forward between the transporting path and the delivery guide device while suctioning the wrapping sheet to be provided in the wrapping sheet supply device, and for the spacing between the plurality of suction belts to gradually separate on the work piece transporting path side such that tension is placed on the wrapping sheet. Preferably, the suction belts are arranged so as to gradually spread out like a folding fan such that the spaces between the suction belts widen on the distal end side.

As a result of this, the wrapping sheet can be supplied to the transporting path in a tensioned state without any wrinkling. It is also possible for at least three suction belts to be provided, and for a non-suction area to be provided in the suction belt located in the center in the vicinity of the transporting path of the work piece. By making the distal end side of the center suction belt a non-suction portion, when the wrapping sheet is pushed by the work piece and is wrapped the wrapping sheet can be smoothly separated from the suction belt.

It is also possible for there to be provided an air guide that discharges de-electrification air in the transporting direction of the wrapping sheet onto the wrapping sheet being transported by the suction belts.

Static electricity on the surface of the wrapping sheet is removed and neutralized by the de-electrification air, and the portion of the wrapping sheet that protrudes from the suction belt is made taut so that the work piece can be wrapped without any wrinkles.

Additional features and advantages of the present invention are described in, and will be apparent from, the following Detailed Description and the Figures.

DETAILED DESCRIPTION

Figure 1:
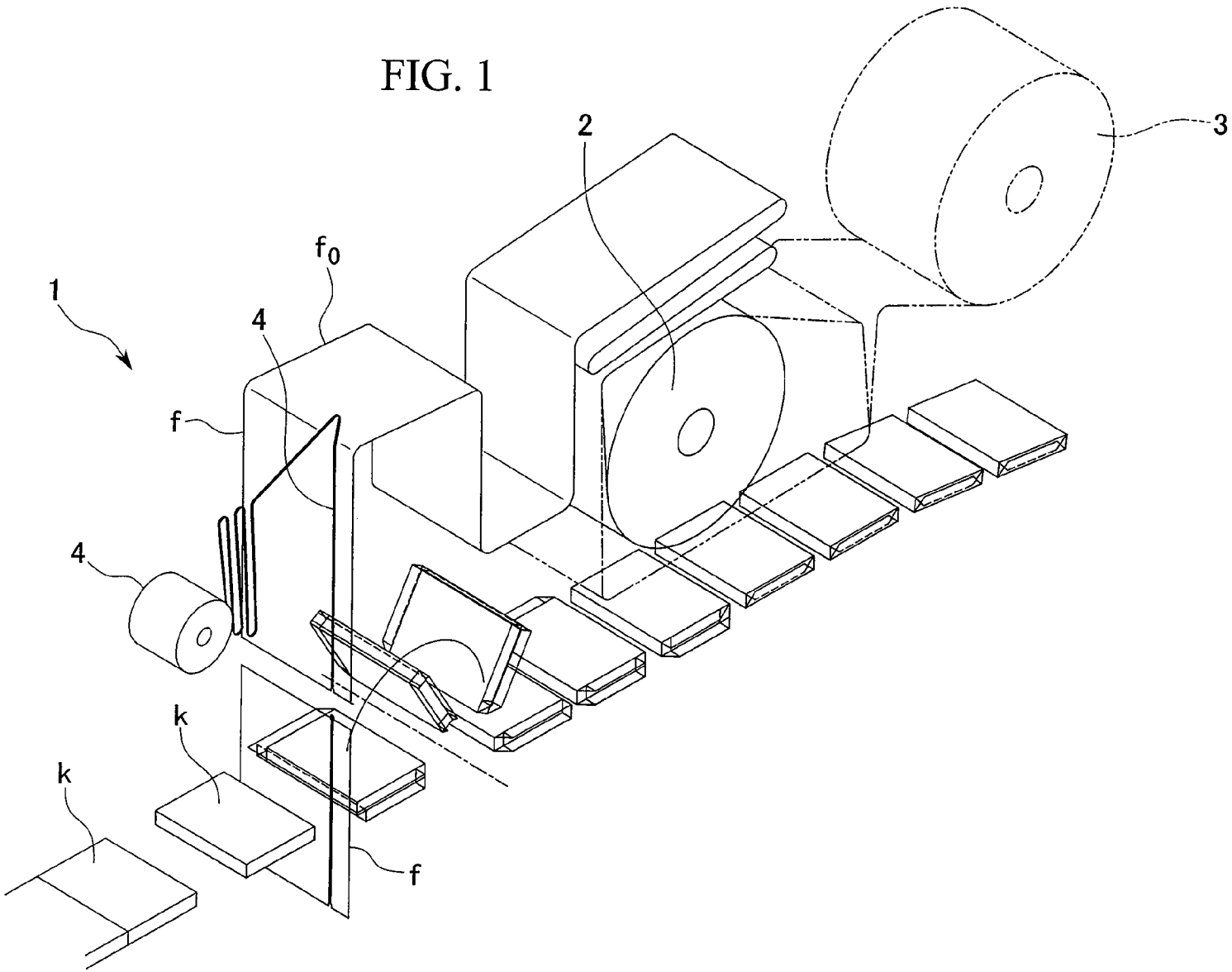
FIG. 1 is a perspective view showing principal portions of a wrapping process to wrap and package a case of a wrapping apparatus according to an embodiment of the present invention.

Preferred embodiments of the present invention will now be described with reference made to the drawings. It should be noted, however, that the present invention is not limited to each of the embodiments described below and it is also possible, for example, to combine together component elements of these embodiments in an appropriate manner.

The wrapping apparatus according to an embodiment of the present invention is described using FIG. 1 through FIG. 9*c*. In a wrapping apparatus 1 shown in FIG. 1, work pieces in the form of rectangular plate-shaped cases (referred to below simply as a cases) k such as, for example, DVD cases are individually covered by a film f and wrapped. They are then placed inside pockets that are formed at predetermined intervals in a circular plate-shaped turret. The film is then wrapped in the aperture portion of the pocket and is then sealed by a heater so as to be sealed as a package. After the pocket has been inverted 180 degrees by the turret from the position where the case k was placed inside the pocket, the case k is ejected, both side portions thereof are flap folded and then sealed. The film f is unwound from a film reel 2 or from a second film reel 3 and a tear tape 4 is superimposed partway along and the film f is cut into predetermined lengths. The film f is then drawn out onto the transporting path of the cases k so as to be supplied to a position in front of the aperture of the pocket that is located on the transporting path.

Figure 2:
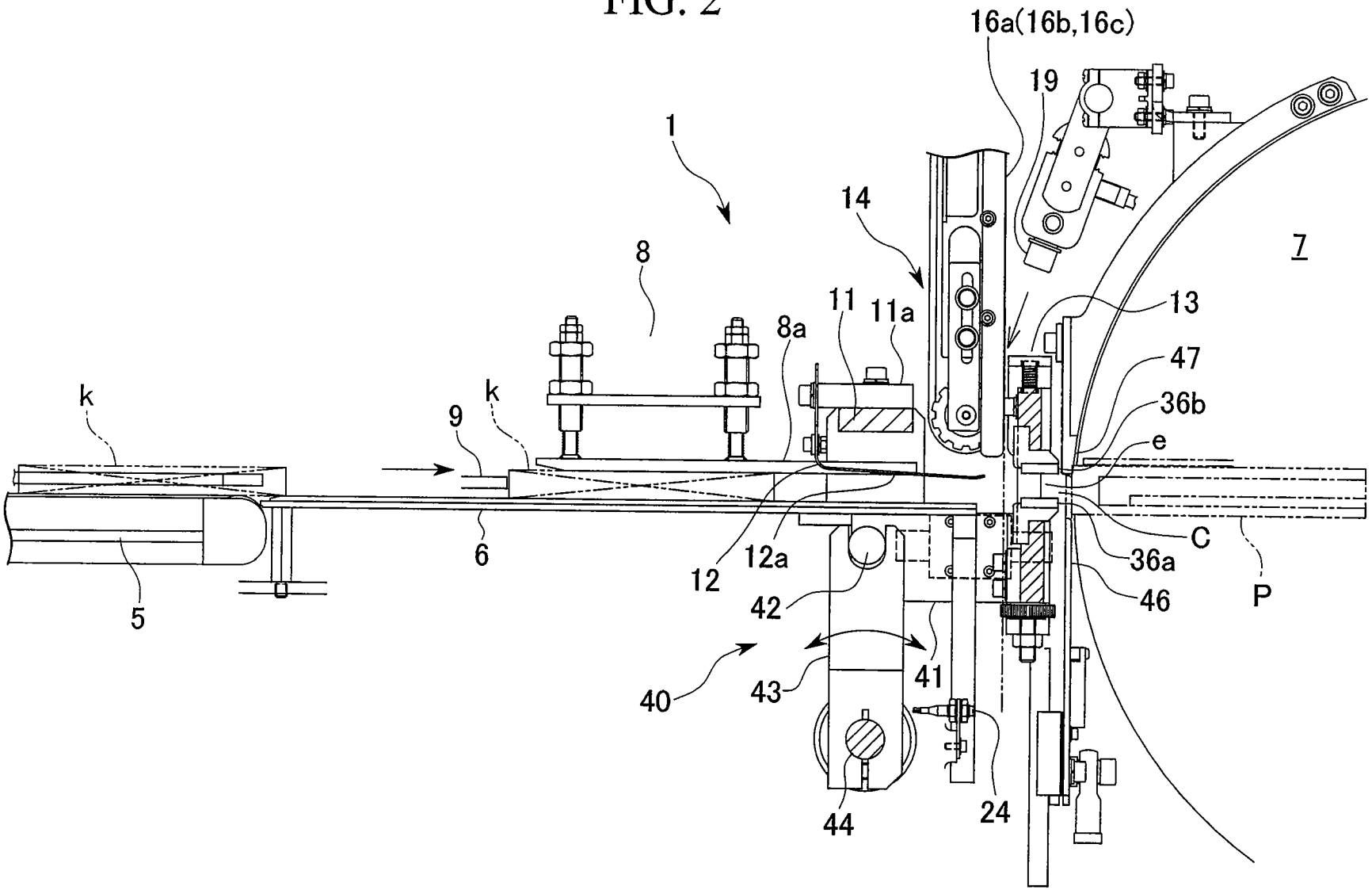
FIG. 2 is a structural view of principal portions of a wrapping apparatus showing a transporting path for a case, a film supply device, a delivery guide device, and a turret having case receiving pockets of the wrapping apparatus.

In the wrapping apparatus 1 shown in FIG. 2, there are provided a supply conveyor 5 that sequentially transports cases k, a transporting path 6 that receives the cases k at the front of the supply conveyor 5 and then continues transporting them, and a turret 7 that is positioned at the front of the transporting path 6 and is provided with a plurality of pockets that are located at predetermined intervals in the radial direction of the turret 7 and receive the cases k through apertures in the outer circumferential surface thereof. The cases k that are moved along the transporting path 6 are pushed by a pusher 9 into the pocket P that is positioned on an extended axial line of the transporting path 6. An upper guide 8 that sandwiches the cases k from above and below between itself and the transporting path 6 is provided on the transporting path 6. Guide plates 8*a* and 8*a* that press the cases k towards the transporting path 6 are connected to the upper guide 8.

Figure 3:
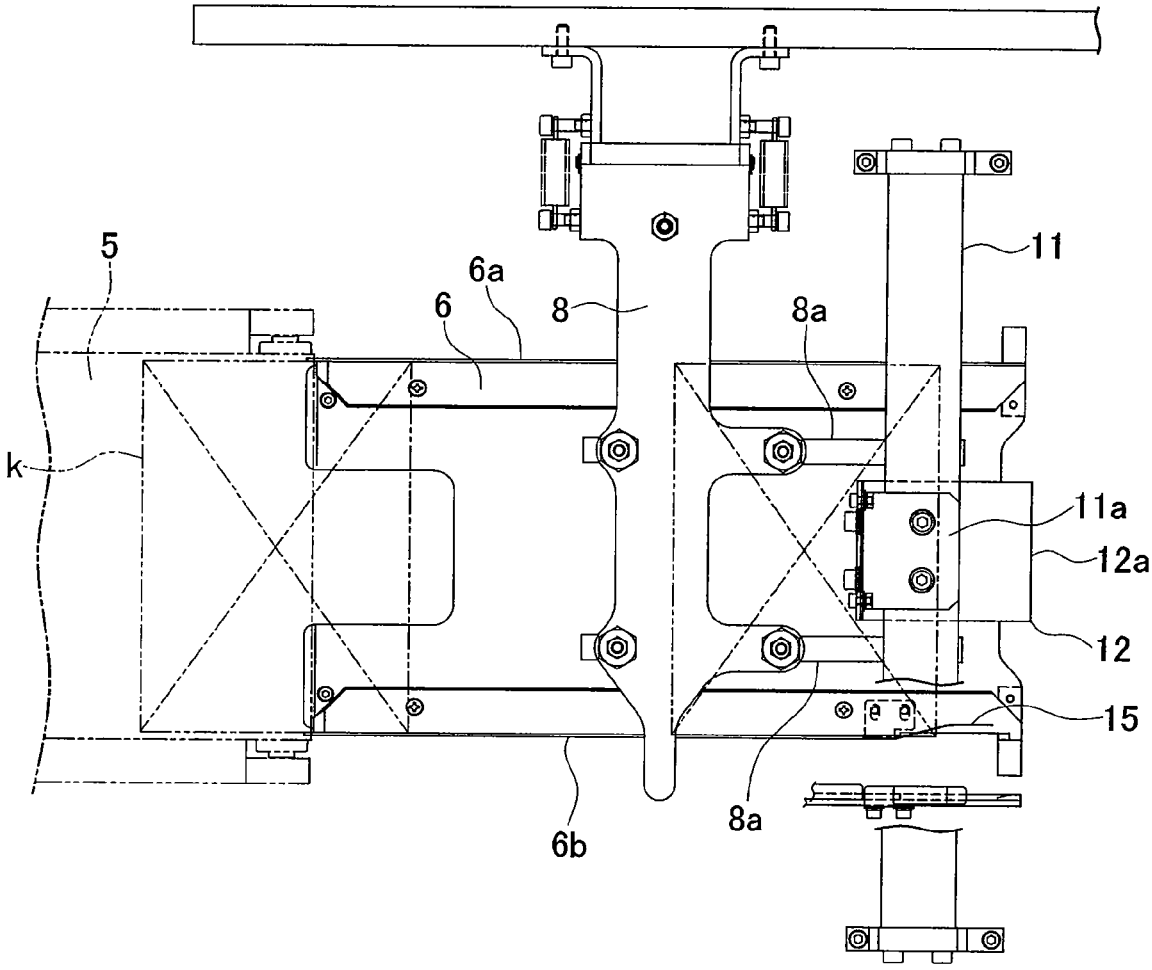
FIG. 3 is a plan view of an upper guide and a correction guide of the transporting path.

In FIG. 2 and FIG. 3, a beam 11 that is connected to the apparatus body extends in a direction that is orthogonal to the transporting path 6 in a front area between the guide plates 8*a* and 8*a*. A correction guide 12 that is used to correct any crookedness or bending in the case k by pressing the case k further against the transporting path 6 is provided on a base plate 11*a* that is fixed to the beam 11. The correction guide 12 is formed by a plate spring that has a substantially L-shape configuration when viewed from a side thereof, and an upper portion thereof is fixed to the base plate 11*a*, while a lower portion thereof forms a pressing portion 12*a* that protrudes towards a distal end side from between the guide plates 8*a* and 8*a* and that is inclined so as to protrude closer than the guide plates 8*a* and 8*a* towards the transporting path 6.

In FIG. 3, side surface guides 6*a* and 6*b* that guide the transporting direction of the cases k are provided at both side surfaces of the transporting path 6. On the distal end side of the side surface guides 6*a* and 6*b* an elastic component in the form of a single side accumulating guide 15 is provided at a distal end of the other side surface guide 6*b* in order to push the cases k into position against the one side surface guide 6*a*.

In addition, a delivery guide device 13 is provided in a space c between the transporting path 6 and the pockets P, while a film supply device 14 that supplies the film f to a position between the transporting path 6 and the delivery guide 13 is provided between the delivery guide 13 and the beam 11.

Figure 4:
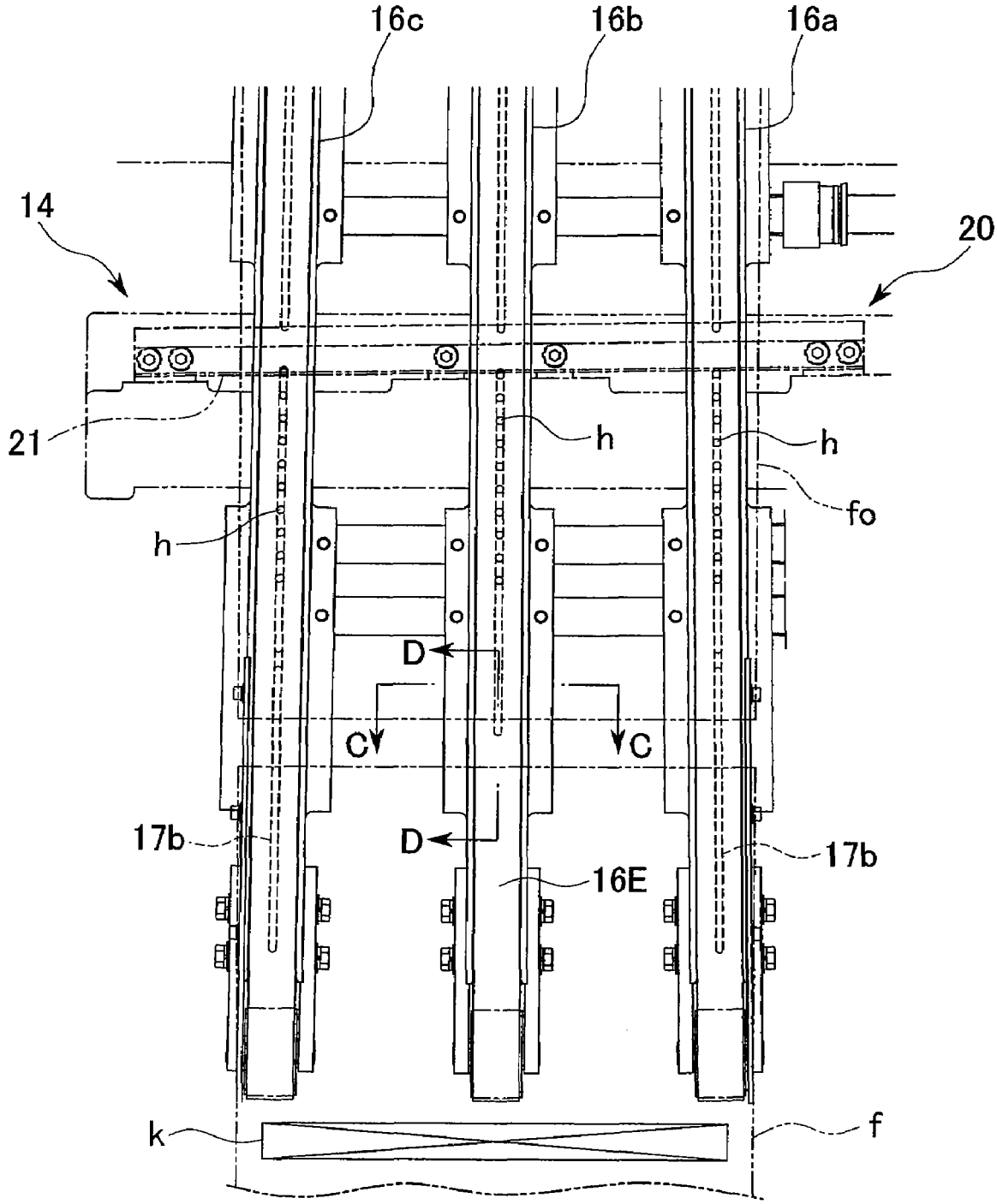
FIG. 4 is a frontal view showing principal portions of the film supply device.

Next, the film supply device 14 will be described with reference made to FIG. 4 through FIG. 6. In FIG. 4, a plurality of, for example, three suction belts 16*a*, 16*b*, and 16*c* are provided in a row at a predetermined spacing in the film supply device 14 in order to supply a film fo to the space c between the transporting path 6 and the delivery guide device 13. Each of the suction belts 16*a*, 16*b*, and 16*c* is wound respectively between pairs of sprockets that are arranged in a row orthogonally to the transporting path 6, and distal ends thereof face the space c in front of the transporting path 6. The drive side sprockets are connected to each other via a coupling. Moreover, the suction belts are arranged substantially in a three-pronged dovetail pattern with the interval between the suction belts 16*a* and 16*c* on the two sides of the central suction belt 16*b* becoming gradually larger as they approach the distal end.

Figure 5A:
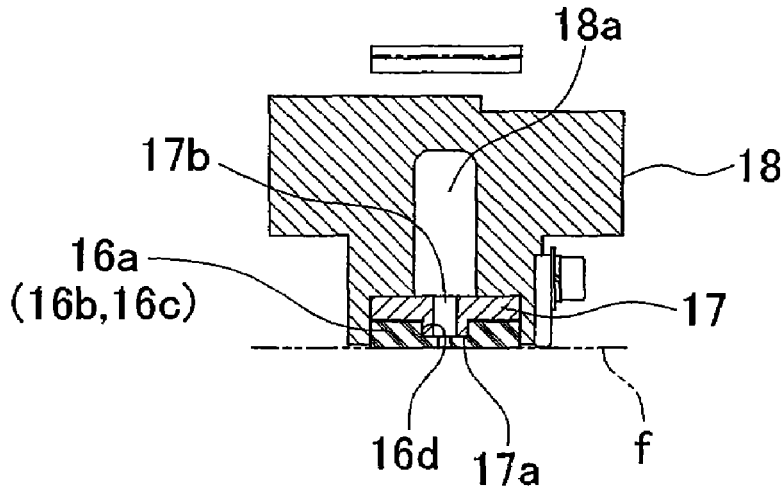
FIG. 5A is a cross-sectional view taken along a line C-C that runs in a direction that is orthogonal to the supply direction of the film supply device in FIG. 4.

In FIG. 4 and FIG. 5, suction holes h that are used to suction air are formed at predetermined intervals over the entire length of the respective suction belts 16*a*, 16*b*, and 16*c*. Guide plates 17 and chamber portions 18 are provided sequentially so as to be fixed to the rear surface of the portions of each of the endless suction belts 16*a*, 16*b*, and 16*c* that transport the film f. On one of the contact surfaces between the respective suction belts 16*a*, 16*b*, and 16*c* and the guide plates 17, for example, on the guide plates 17, there are provided projecting portions 17*a*, while on the other of the contact surfaces, for example, on the suction belts 16*a*, 16*b*, and 16*c*, there are provided recessed portions 16*d* that can engage with the projecting portions 17*a* by sliding into them. As a result of this meshing type of engagement between the suction belts and the guide plates 17, it is difficult for the suction belts to fishtail, and it is also difficult for air leaks to occur.

Moreover, elongated hole-shaped through holes 17*b* that communicate with the suction holes h are provided at a predetermined spacing in the projecting portions 17*a* of the guide plates 17, while air chambers 18*a* that communicate with the through holes 17*b* are provided at a predetermined spacing in the chamber portions 18. Because the air chambers 18*a* are suctioned by a suction apparatus (not shown), the film f that has been mounted on the respective suction belts 16*a*, 16*b*, and 16*c* that rotate circumferentially along the projecting portions 17*a* of the guide plate 17 is transported while being suctioned via the respective through holes 17*b* and the respective suction holes h. In addition, because the space between the respective suction belts 16*a*, 16*b*, and 16*c* increases as they approach the distal end in the transporting direction, the film f can be transported while being held in a tensioned state.

Figure 5B:
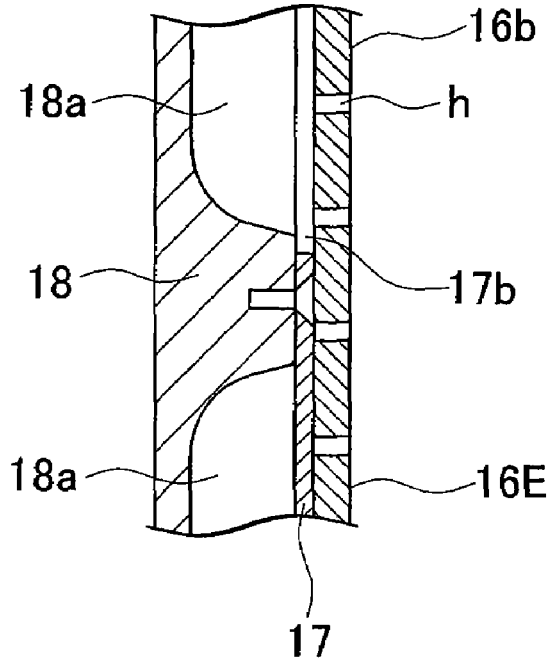
FIG. 5B is a cross-sectional view taken along a line D-D that runs in the supply direction of a central film supply device also in FIG. 4.

It is possible to transport the film f under suction as a result of the through holes 17*b* being provided in the projecting portions 17*a* of the guide plates 17 from the base end side to the distal end side of the two side suction belts 16*a* and 16*c*. In contrast, as is shown in FIG. 5B, in the center suction belt 16*b*, although the through holes 17*b* that communicate with the air chambers 18*a* are provided in the projecting portions 17*a* of the guide plates 17 from the base end side as far as a point partway along, the through holes 17*b* are not provided in the distal end side thereof. As a result, this area constitutes a non-suction area 16E where the film f is not suctioned. In the non-suction area 16E, the suction force of the film f is reduced and by pushing the cases k the film f is able to be easily separated from the suction belts 16*a*, 16*b*, and 16*c* and wrapped.

Moreover, an ionizer 19 (i.e., an air guide) is located facing the suction belts 16*a*, 16*b*, and 16*c*, and by blowing out ionic air in order to neutralize static electricity in the feed direction of the film f, any static electricity remaining in the film f is removed (refer to FIG. 2). Moreover, the ionic air flattens out the film that is protruding freely beyond the distal end side of the respective suction belts 16*a*, 16*b*, and 16*c* so that the occurrence of any wrinkling is prevented.

Figure 6:
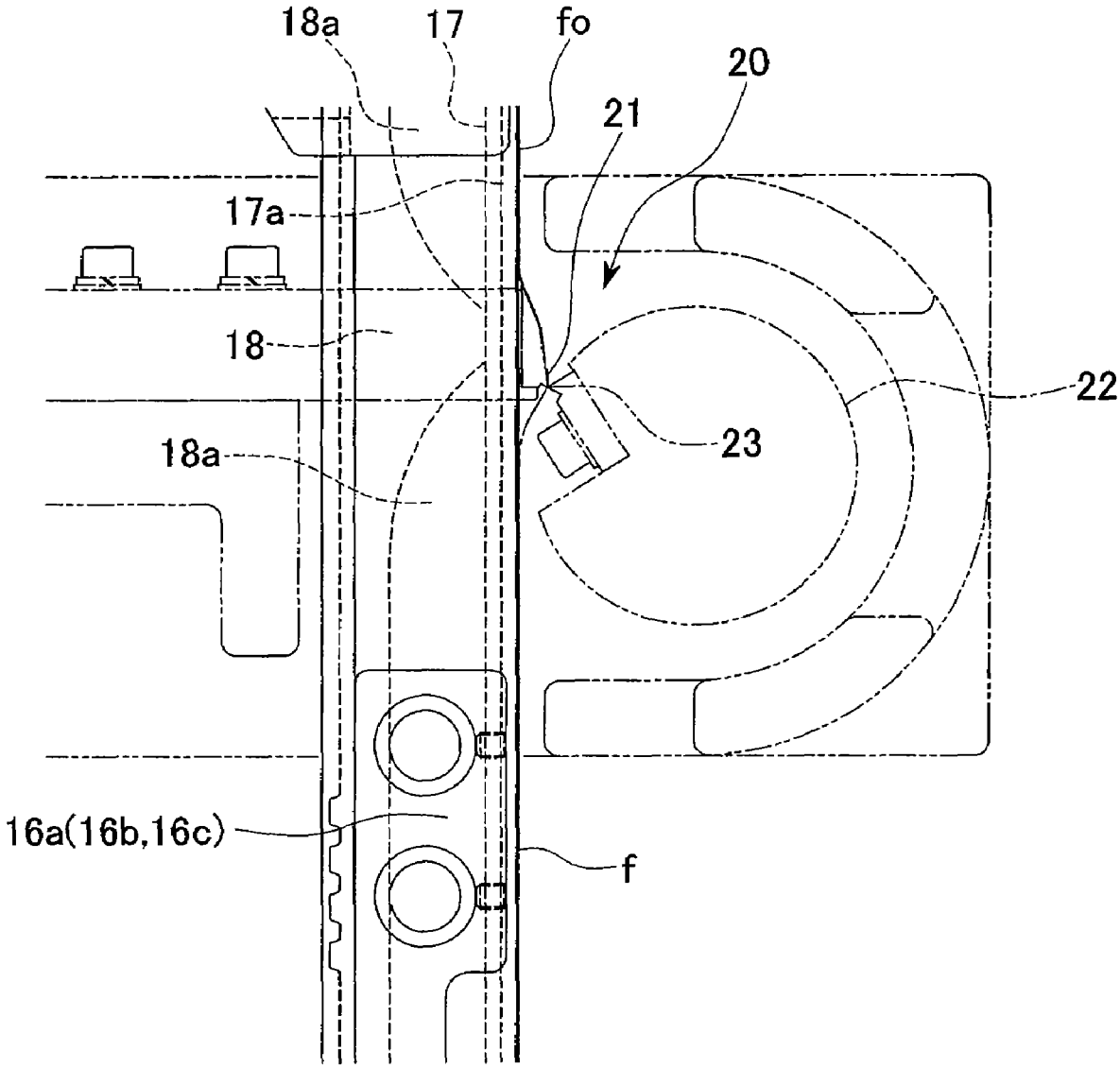
FIG. 6 is a view showing a film cutter in the film supply device.

In FIG. 4 and FIG. 6, a cutter 20 is provided orthogonally to the respective suction belts at a midway portion in the longitudinal direction of the respective suction belts 16*a*, 16*b*, and 16*c*. This cutter 20 cuts the film fo that is continuously unwound from the film reel 2 into predetermined lengths and then transports them to the distal end side. Because of this, a receiving blade 21 that is orthogonal to the respective suction belts and is inclined such that the height thereof increases as it approaches the distal end side is provided on the surface of the respective suction belts 16*a*, 16*b*, and 16*c*. A rotating blade 23 that protrudes from an outer circumferential surface of a rotatable cylinder-shaped rotary portion 22 is provided at a position facing the receiving blade 21. Preferably, the rotating blade 23 is formed so as to be offset (i.e., inclined) from one end to the other end thereof in a forward-backward direction of the direction of rotation from the receiving blade 21.

As a result, when the film f is sandwiched between the receiving blade 21 and the rotating blade 23 and the rotating blade 23 is rotating, the two blades 21 and 23 gradually intersect each other from one end side to the other end side thereof and cut the film fo like scissor blades. The film f that has been cut into predetermined lengths by the cutter 20 is transported towards the distal end side by the suction belts 16*a*, 16*b*, and 16*c*. Only the rear end portion thereof is suctioned and held by the suction holes h and h in the side suction belts 16*a* and 16*c* and, in this state, the majority portion of the film f protrudes so as to hang downwards inside the space c extending past the transporting path 6 of the cases k and is able to be wrap folded. Because of this, there is provided a sensor 24 (refer to FIG. 2) that detects a bottom edge of the film f that is hanging down from the suction belts 16*a*, 16*b*, and 16*c*.

Moreover, because the speeds of the respective suction belts 16*a*, 16*b*, and 16*c* are controlled such that the film f is transported at a faster speed than the transporting device of the preceding film fo, gaps are generated by the speed difference between the film f that has been cut by the cuter 20 and the film fo that is continuously unwound from the film reel 2, and the cases k are wrapped and inserted into the pockets P of the turrets 7 in the timing of these gaps. The sensor 24 detects the supplying of the film f at predetermined timings, and if the film f cannot be detected at the predetermined timing it is assumed that a film blockage has occurred and the apparatus is brought to an emergency stop.

Next, the delivery guide device 13 will be described based on FIG. 7, FIG. 8, and FIG. 9. The delivery guide 13 is provided with a pair of delivery guide portions 25*a* and 25*b* that are placed substantially in parallel above and below a transit aperture e through which the cases k are made to transit. One delivery guide portion (for example, the lower delivery guide portion 25*a*) has two ends that are fixed by a substantially U-shaped receiving component 26*a*, and the two ends of this receiving component 26*a* are fixed to holder portions 33A of lower holders 33. The receiving component 26*a* is connected to the holder portions 33A such that the height thereof can be adjusted by inserting a bolt that is fitted to the holder portions 33A in an elongated hole of the receiving component 26*a*. As a result, the position of the height of the lower delivery guide 25*a* can be adjusted and held in a position that corresponds to the bottom surface of the cases k that are being transported. The lower holders 33 are fixed to plates 41.

The other delivery guide portion (for example, the upper delivery guide portion 25*b*) has two ends that are fixed by a substantially U-shaped receiving component 26*b*, and both ends of this receiving component 26*b* are held such that they can be moved in a vertical direction by upper holders 31 and 31. Each upper holder 31 is fixed to a shaft 32 and bottom ends of these shafts 32 pass through the holder portions 33A and are mounted on shaft portions 28 that are rotatably supported. Pins 32*a* that are provided in each shaft 32 are inserted into elongated holes 33*a* in the lower holder 33 and each shaft 32 and upper delivery guide portion 25*b* are held such that they can move vertically within the range of the elongated holes 33*a*. Adjustment grippers 34 that screw onto the respective shaft portions 28 are provided between the lower holders 33 and the holder portions 33A. The shaft portions 28 are attached to the holder portions 33A by nuts.

Because of this, when making an adjustment using the adjustment grippers 34, the shaft portions 28 can be moved up or down by rotating each adjustment gripper 34 when the nuts have been loosened. This enables the other delivery guide portions 25*b* to be moved up or down via the shafts 32 so that the gap between the delivery guide portions 25*b* and the delivery guide portions 25*a* can be adjusted.

Figure 7:
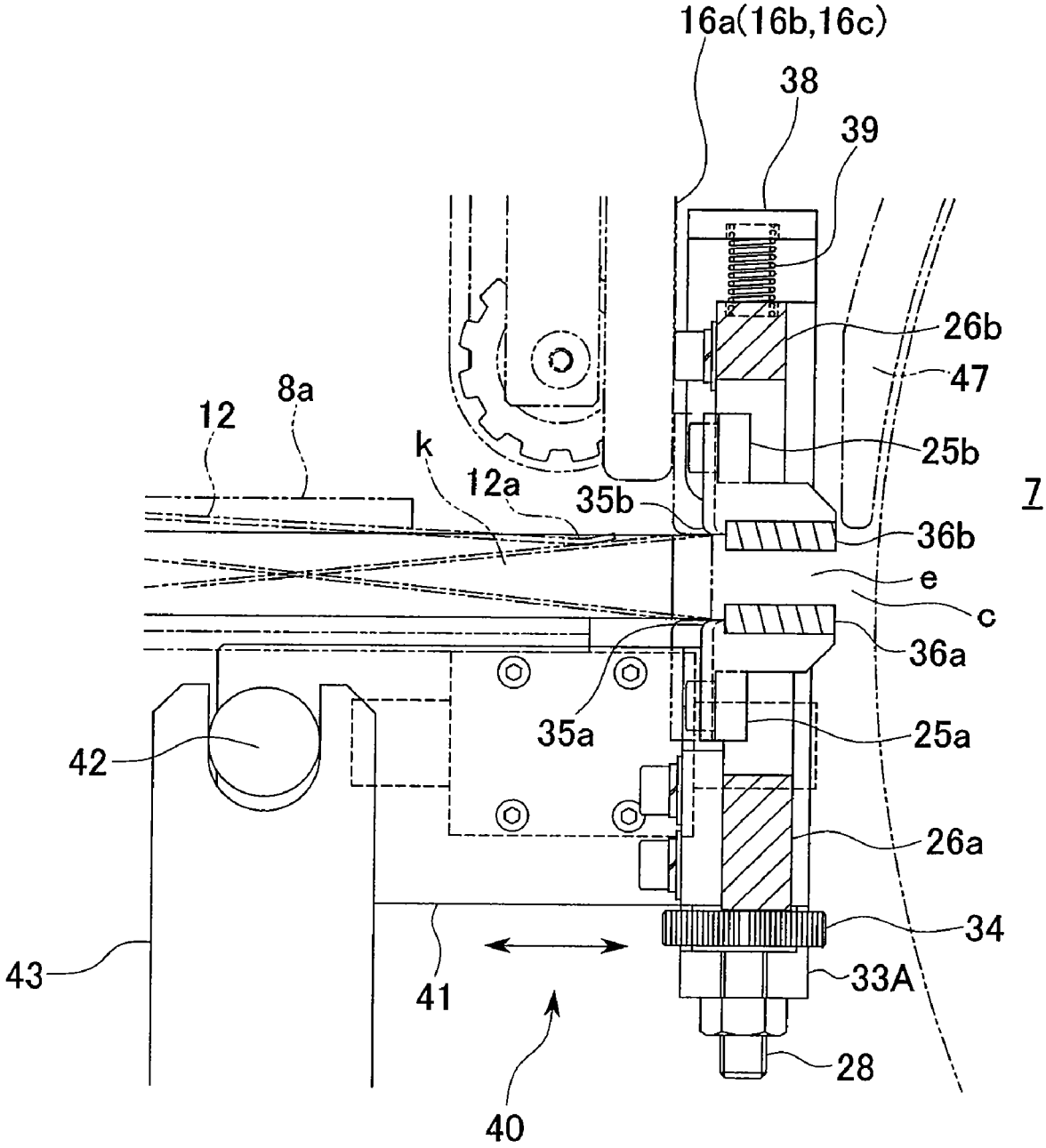
FIG. 7 is an enlarged view of the delivery guide device in FIG. 2.
Figure 8:
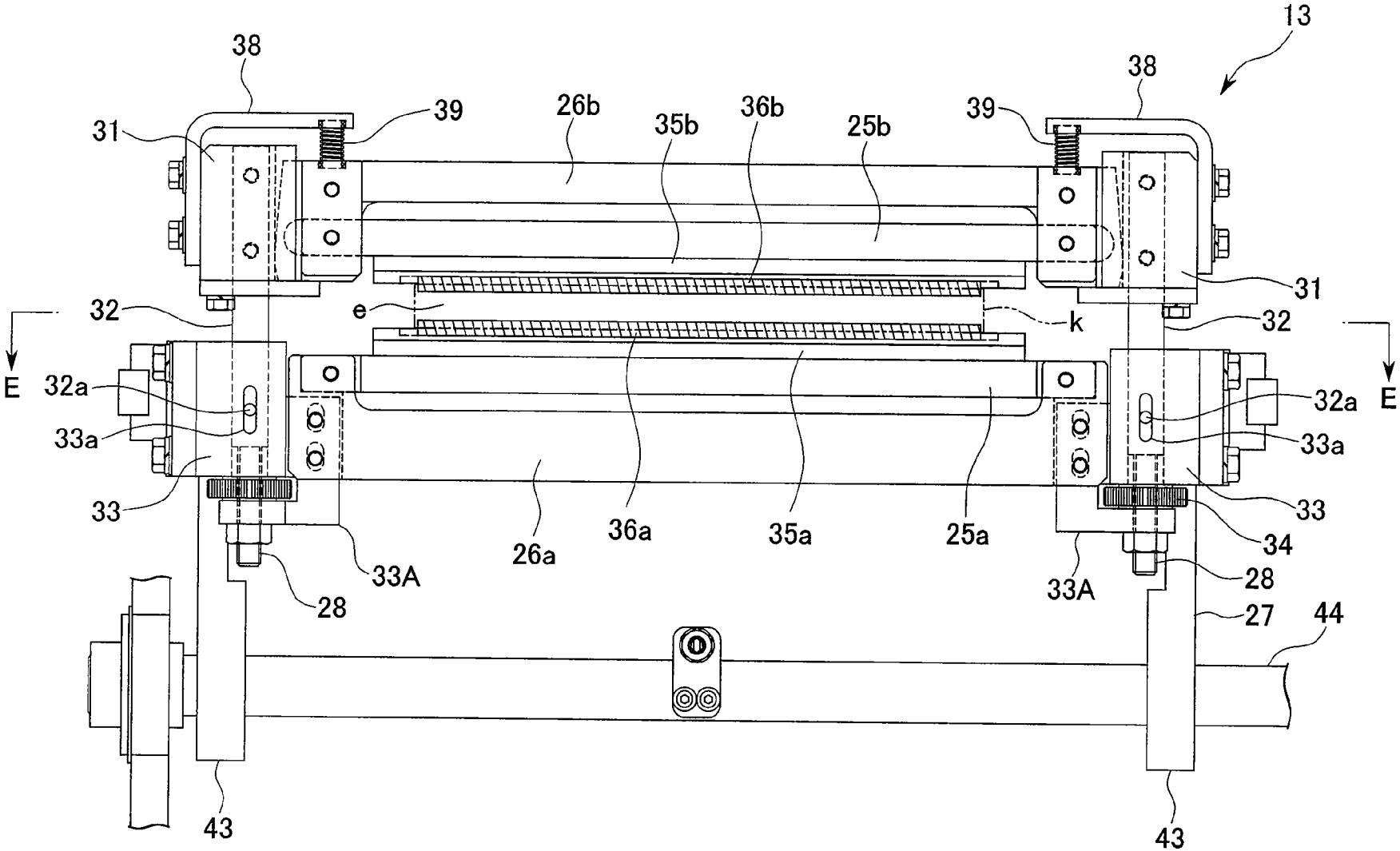
FIG. 8 is a frontal view of the delivery guide device.
Figure 9:
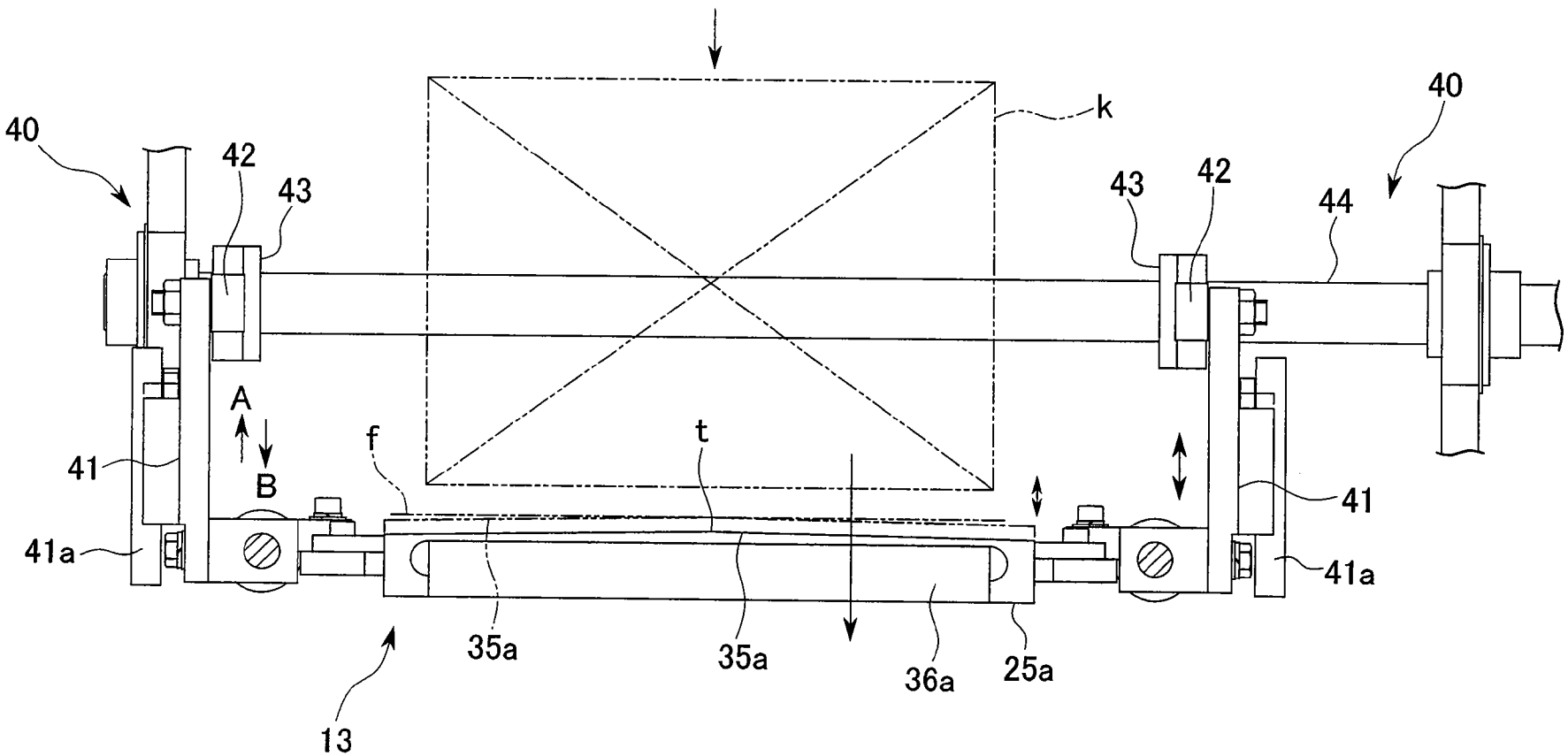
FIG. 9 is a plan view showing a cross-section taken along a line E-E of the delivery guide device.

In addition, as is shown in FIG. 7 and FIG. 9, V-shaped guide portions (i.e., spreading guides) 35*a* and 35*b* in which, when seen in plan view, a central portion t protrudes towards the film f side (i.e., towards the rear in the transporting direction of the cases k) so as to substantially form a V shape, are provided respectively on opposing surfaces of the upper and lower delivery guide portions 25*a* and 25*b*. The pair of V-shaped guide portions 35*a* and 35*b* face each other across a gap that is slightly larger than the thickness of the cases k. The film f that is being pressed by a case k is pushed from the center portions of the top and bottom surfaces of the case outwards towards both outer sides by the pair of V-shaped guide portions 35*a* and 35*b* so that, at the same time, any wrinkling in the center portion is pushed out towards the outside and the case k can be wrapped. At the distal end surface in the direction of forward movement of the case, the residual air between the film f and the case k is also pushed out from the center portion to both sides so that the film f is tightly contacted to the case k.

Moreover, smoothing pads 36*a* and 36*b* that are formed from artificial fabric are contacted to the opposing surfaces of the upper and lower delivery guide portions 25*a* and 25*b*. The respective smoothing pads 36*a* and 36*b* are placed further on the pocket P side than the V-shaped guide portions 35*a* and 35*b*, and a large number of bristles stand upright to approximately the same length. The space between the two smoothing pads 36*a* and 36*b* is set to be slightly smaller than the thickness of the cases k (refer to FIG. 8). For example, if the thickness of the case k is 15±0.5 mm, then the bristles respectively protrude inwards approximately 2.5 mm. Moreover, each of the smoothing pads 36*a* and 36*b* has a width that enables it to press against and consequently deform the entire width of both top and bottom surfaces of the cases k, and as a result of the cases k passing between the two smoothing pads 36*a* and 36*b* as the film f is being wrap folded, the film f is tightly pressed so as to conform to all the bumps and indentations in the surface of the cases k and squeeze out all the air.

Substantially L-shaped supporting plates 38 and 38 that extend over the upper receiving component 26*b* are provided on the upper holders 31, and elastic components 39 such as coil springs or the like are provided respectively between each supporting plate 38 and the receiving component 26*b*. If the thickness of the cases is too large due to dimensional discrepancies when the cases k are made to pass between the smoothing pads 36*a* and 36*b*, then the upper delivery guide portion 25*b* compresses the elastic components 39 and is made to move away. As a result, even if the thickness of the cases k is larger than the transit aperture e, the cases k can still be transited.

In FIG. 2 and FIG. 9, in the delivery guide device 13, plates 41 and 41 that support the bottom holders 33 and 33 at both ends of the delivery guide device 13 are able to move forwards and backwards using slide guides 41 a that are held by a frame (not shown) to which they are fixed. The two plates 41 and 41 are connected to a swinging power source (not shown) via cam followers 42 and 42, drive levers 43 and 43, and a power shaft 44. By driving the power source the drive levers 43 are made to swing around the power shaft 44, and the delivery guide device 13 is moved forward or backward in the transporting direction of the cases k. These components constitute a swinging mechanism 40.

The delivery guide device 13 is in a position away from the film f until the film f arrives at the position where it presses against the cases k. When the cases are being pressed, the delivery guide device 13 is moved to a position adjacent to the film f so that the film f that has been wrapped around a case k doesn't become inflated or flap about.

As a result, when the cases k press against the film f that is hanging down at the suction belts 16*a*, 16*b*, and 16*c* and are wrapped, the delivery guide device 13 approaches the film f and the cases k are easily inserted into the transit aperture e between the delivery guide portions 25*a* and 25*b*, and the delivery guide device 13 then swings to the turret 7 side so that it is easy for the cases k to be delivered to the pockets P.

Moreover, in FIG. 2, a wrapping tucker 46 that is used to fold the lower flap of the film f onto a side surface of the cases k is positioned extending in a vertical direction at a bottom side sandwiching the apertures of the pockets P that receive the cases k between the delivery guide device 13 and the turret 7. On the upper side of this aperture, an arc-shaped guide 47 is provided extending along the arc-shaped configuration of the turret 7. The arc-shaped guide 47 folds down the upper flaps using the rotation of the turret 7.

The wrapping apparatus 1 according to the present embodiment has the above described structure. Next, a wrapping method using this wrapping apparatus will be described. In FIG. 2, a number of cases k are placed on the transporting conveyor 5 and are transported in sequence so as to be pushed onto the transporting path 6. They are then pushed over the transporting path 6 by the pusher 9 and are sandwiched between the transporting path 6 and the upper guide 8. They are then further pushed by the pusher 9 and because the top surfaces of the cases k are pressed by the pressing portion 12*a* of the correction guide 12 so that the cases k are pressed against the transporting path 6, any crookedness or warping of the cases k is corrected.

Meanwhile, the continuous belt-shaped film fo that is unwound from the film reel 2 passes through the fishtail adjuster and is fed onto the suction belts 16*a*, 16*b*, and 16*c*. A tear tape 4 that is unwound from a reel is then contacted to one surface of the film fo so that the two can be transported as a single body on the suction belts 16*a*, 16*b*, and 16*c*. The film fo that is suctioned through the respective suction holes h in the suction belts 16*a*, 16*b*, and 16*c* is then fed forward in the direction of the transporting path 6 (i.e., downwards in the drawing) of the cases k as a result of the suction belts 16*a*, 16*b*, and 16*c* being driven.

Next, in FIG. 4, when a predetermined length of the film fo passes the receiving blade 21 of the cutter 20 that is aligned in a direction that is orthogonal to the longitudinal direction of the suction belts 16*a*, 16*b*, and 16*c*, the rotating blade 23 of the rotary portion 22 that is rotating at a predetermined speed intersects with the receiving blade 21 and cuts the film fo into predetermined lengths. As a result, wrapping sheets in the form of the film f are formed. At this time, the rotating blade 23 gradually intersects from one end side to the other end side thereof with the receiving blade 21 so as to make a scissor-like cut and cut the film fo. Even if the film fo is a fragile material, a clean cut with no errors can be made (refer to FIG. 6).

The film f that has been cut into predetermined lengths is further transported in the direction of the distal end (i.e., downwards) by the suction belts 16*a*, 16*b*, and 16*c*, however, because the suction belts 16*a* and 16*c* on the two sides open up at the distal end sides thereof to form a dovetail pattern relative to the central suction belt 16*b*, as the film f moves in the direction of the distal end, it is pulled towards both sides in the transverse direction and is held in a tensioned state having no wrinkling or looseness or the like. The distal end of the film f then further protrudes from the suction belts 16*a*, 16*b*, and 16*c* and hangs downwards to where it is detected by the sensor 24 (refer to FIG. 2). In this state, as is shown in FIG. 4, the rear end of the film f is suctioned by the suction holes h in the distal end portions of the two side suction belts 16*a* and 16*c*, so that the film f is positioned in the non-suction area 16E above the center suction belt 16*b*. Because of this, during wrapping, the film f is not distorted. Static electricity is then removed from the film f by ionic air that is blown out from the ionizer 19. Moreover, because the film f that is hanging down from the respective suction belts 16*a*, 16*b*, and 16*c* is directed downwards by the ionic air, no wrinkling or the like is generated in the film f.

In this state, the swinging mechanism 40 shown in FIG. 2 and FIG. 9 is operated, the power levers 43 are operated so as to rotate around the power shaft 44, and the delivery guide device 13 is swung via the levers 41 to a position adjacent to the film f (i.e., in the A direction in FIG. 9). The case k that is sandwiched between the correction guide 12 and the transporting path 6 is further pushed by the pusher 9, and is positioned at the distal end of the transporting path 6 by being pushed by the single side accumulating guide 15 against one side surface guide 6*a*. The case k is then made to protrude from the distal end of the transporting path 6 towards the openings of the pockets P that face the turret 7. Subsequently, this case k presses against the center portion in the longitudinal direction of the spread out film f that is hanging down from the suction belts 16*a*, 16*b*, and 16*c*, and, by bending the film f so that the film f is folded in two around the case k, becomes covered by the film f. The case k is then pushed into the transit aperture e between the pair of delivery guide portions 25*a* and 25*b* of the delivery guide device 13.

The film f is gradually spread out in the direction of the two edges from the center portion in the transverse direction of the top and bottom surfaces of the case k by the V-shaped guide portions 35*a* and 35*b*. As a result, the film f covers the case k with any wrinkles and the like being spread out from the center towards the outer sides. When the case k is then inserted into the transit aperture e, it moves forward between the smoothing pads 36*a* and 36*b* and the bristles of the respective smoothing pads 36*a* and 36*b* individually press the film f against the top and bottom surfaces of the case k. As a result, the film f is tightly contacted so as to conform to the bumps and indentations in the top and bottom surfaces of the cases k. Accordingly, the film f can be pushed towards the outside without any wrinkling remaining, and without any air being left between the film f and the top and bottom surfaces.

In conjunction with this insertion of the case k, the delivery guide device 13 is rotated by the swinging mechanism 40 around the power shaft 44 at a slower speed than the movement of the case k, and is moved (in the B direction in FIG. 9) to a position adjacent to the opening in a pocket P in the turret 7. Upon then being further pushed by the pusher 9, the case k is placed in a wrapped state with the film f being tightly contacted to the top and bottom surfaces of the case k and is placed inside a pocket P. At this time, small flaps of the film f are folded down on both side surfaces of the case k.

In this state, the top and bottom flaps on the rear side of the film f that has been folded around the case k protrude externally from the opening in the pocket P. Next, by moving the wrapping tucker 46 upwards, the bottom flap is folded against the rear end surface of the case k. If the turret 7 is then rotated clockwise (as seen in FIG. 2) around its center axis, the upper flap is pressed by the arc-shaped guide 47 and is folded over the bottom flap. In this manner, the case k can be fully wrapped and is then sealed using a heater (not shown). Next, the turret 7 is stopped when an empty pocket P arrives at a position facing the transit aperture e of the delivery guide device 13, and the above described supply of a case k and wrapping operation of the film f are repeated.

Note that even if the dimensions of the cases k are inconsistent, because it is possible when the cases k are being fed out from the transporting path 6 to position the cases k at the one side surface guide 6*a* using the single side accumulating guide 15, during wrapping, the cases k can be wrapped cleanly without becoming tilted.

Moreover, even if the thickness of the cases k is smaller than the standard thickness due to dimensional inconsistencies, when the cases k pass through the smoothing pads 36*a* and 36*b* the film f is pressed against the top and bottom surfaces of the case k so that residual air is expelled and tightly contacted wrapping is achieved. Alternatively, even if the thickness of the cases k is larger than the standard thickness, during insertion the cases k push the V-shaped guide portion 35*b* upwards against the urging force of the elastic component 39 so that the delivery guide portion 25*b* is able to withdraw in an upward direction. As a result, while the gaps between the V-shaped guides 35*a* and 35*b* and the smoothing pads 36*a* and 36*b* are being adjusted, the film f can be tightly contacted to the top and bottom surfaces of the cases by the smoothing pads 36*a* and 36*b*. Because of this, even if there are dimensional inconsistencies or top and bottom surface irregularities in the cases k, any defects in the wrapping can be absorbed.

According to the above described embodiment, when a case k is being wrapped, the film f can be supplied to the case k without any wrinkling and in a tensioned state. While the film f is being pushed outwards from the center area to both outer sides by the V-shaped guide portions 35*a* and 35*b*, wrapping can be achieved without any wrinkling occurring in the center portion of the film f. Furthermore, any residual air remaining between the case k and the film f is pushed out by the smoothing pads 36*a* and 36*b*, so that the film f is tightly contacted to the case k while conforming to the surface configuration thereof without any wrinkling occurring. As a result, wrapping with an attractive appearance can be achieved. Because of this, a shrinking machine that heat shrinks the film f after the wrapping process in order to remove wrinkles is rendered unnecessary, and a reduction in the overall floor space occupied by the wrapping apparatus 1 can be achieved, thereby reducing costs. Moreover, it is possible to correct any crookedness in the cases k using the correction guide 12 prior to perform wrapping, and it is also possible to absorb any dimensional inconsistencies that might exist in the cases k using the elastic component 39 and the smoothing pads 36*a* and 36*b*. As a result, the product yield after the packing is improved.

Note that the number of suction belts is not limited to three and, provided that they are able to hold the film f in a tensioned state without any wrinkling, a structure having one, two, or four or more suction belts may also be employed.

It is also possible to employ a structure in which the correction guide 12 is provided on the transporting path 6 side and cases are pushed upwards and held between the correction guide 12 and another sandwiching component. It is also possible to employ a structure in which the correction guide 12 and the transporting path 6 facing it are arranged so as to be inclined relative to each other such that the transporting path 6 gradually approaches the correction guide 12 as they move forward. Moreover, if work pieces such as the cases k and the like are formed from a material and in a shape that makes it difficult for them to become crooked, then it is not necessary to provide the correction guide 12.

It is also possible to employ a structure in which the non-suction area 16E is constructed without the air chamber 18*a* being provided in the chamber portion 18. Moreover, various types of films and paper can be used for the film f such as non-stretch plastic films and work hardened films such as OPP and CPP, and these films and papers constitute a wrapping sheet. Furthermore, the work pieces that are wrapped and packaged in the present invention are not limited to the cases k for DVDs and the present invention may also be applied to other cases and types of products.

INDUSTRIAL APPLICABILITY

According to the wrapping apparatus of the present invention, when a wrapping sheet is pressed by a work piece that is being transported along a transporting path and is made to transit through a transit aperture formed between delivery guide portions, if the wrapping sheet is gradually spread out by a spreading out guide from a central area in the transverse direction of the surface of the work piece in the direction of both edges, then any wrinkling and the like in the center of the wrapping sheet can be pushed out towards the outside and the wrapping sheet can be wrapped around the work piece.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A work piece wrapping apparatus for wrapping a work piece being transported along a transporting path of the work piece in a wrapping sheet, comprising:

a wrapping sheet supply device that supplies the wrapping sheet onto a transporting path of the wrapping sheet intersecting the transporting path of the work piece;

a delivery guide device that includes a pair of delivery guides and causes the work piece to be wrapped by pushing the wrapping sheet with the work piece which is pushed on the transporting path of the work piece so as to cause the work piece to pass through a transit aperture that is provided between the pair of delivery guides; and a spreading guide provided on a periphery of the transit aperture on a surface of each of the pair of delivery guides facing to the rear in a transporting direction of the work piece of the delivery guide device, and whose center area in a transverse direction of the work piece protrudes toward the rear in the transporting direction of the work piece so as to gradually spread the wrapping sheet out from a center area in the transverse direction of the work piece towards both edges thereof with the work piece advances through the transit aperture.

2. The wrapping apparatus according to claim 1, wherein smoothing pads that cause the wrapping sheet to contact tightly to a surface of the work piece are provided on surfaces of the delivery guides facing each other across of the transit aperture, and the smoothing pads are formed by a plurality of bristles and a space between a pair of the smoothing pads that face each other across the transit aperture is set so as to be less than the thickness of the work piece.

3. The wrapping apparatus according to one of claim 2, wherein a correction guide that elastically presses the work piece is provided upstream side from the delivery guide device in the transporting path of the work piece.

4. The wrapping apparatus according to claim 3, wherein a plurality of suction belts that feed the wrapping sheet forward between the transporting path of the work piece and the delivery guide device while suctioning the wrapping sheet are provided in the wrapping sheet supply device, and the spacing between the plurality of suction belts gradually widens on the transporting path side of the wrapping sheet such that tension is placed on the wrapping sheet.

5. The wrapping apparatus according to claim 4, wherein at least three suction belts are provided, and in the suction belt located in the center, a non-suction area is provided in the vicinity of the transporting path of the work piece.

6. The wrapping apparatus according to claim 4, wherein an air guide that discharges de-electrification air towards the wrapping sheet being transported by the suction belts on the transporting path of the wrapping sheet onto the wrapping sheet is provided.

7. The wrapping apparatus according to claim 2, wherein a plurality of suction belts that feed the wrapping sheet forward between the transporting path of the work piece and the delivery guide device while suctioning the wrapping sheet are provided in the wrapping sheet supply device, and the spacing between the plurality of suction belts gradually widens on the transporting path of the wrapping sheet such that tension is placed on the wrapping sheet.

8. The wrapping apparatus according to claim 7, wherein at least three suction belts are provided, and in the suction belt located in the center, a non-suction area is provided in the vicinity of the transporting path of the work piece.

9. The wrapping apparatus according to claim 7, wherein an air guide that discharges de-electrification air towards the wrapping sheet being transported by the suction belts on the transporting path of the wrapping sheet onto the wrapping sheet is provided.

10. The wrapping apparatus according to claim 1, wherein a correction guide that elastically presses the work piece is provided upstream side from the delivery guide device in the transporting path of the work piece.

11. The wrapping apparatus according to claim 10, wherein a plurality of suction belts that feed the wrapping sheet forward between the transporting path of the work piece and the delivery guide device while suctioning the wrapping sheet are provided in the wrapping sheet supply device, and the spacing between the plurality of suction belts gradually widens on the transporting path of the wrapping sheet such that tension is placed on the wrapping sheet.

12. The wrapping apparatus according to claim 11, wherein at least three suction belts are provided, and in the suction belt located in the center, a non-suction area is provided in the vicinity of the transporting path of the work piece.

13. The wrapping apparatus according to claim 11, wherein an air guide that discharges de-electrification air towards the wrapping sheet being transported by the suction belts on the transporting path of the wrapping sheet onto the wrapping sheet is provided.

14. The wrapping apparatus according to claim 1, wherein a plurality of suction belts that feed the wrapping sheet forward between the transporting path of the work piece and the delivery guide device while suctioning the wrapping sheet are provided in the wrapping sheet supply device, and the spacing between the plurality of suction belts gradually widens on the transporting path of the wrapping sheet such that tension is placed on the wrapping sheet.

15. The wrapping apparatus according to claim 14, wherein at least three suction belts are provided, and in the suction belt located in the center, a non-suction area is provided in the vicinity of the transporting path of the work piece.

16. The wrapping apparatus according to claim 14, wherein an air guide that discharges de-electrification air towards the wrapping sheet being transported by the suction belts on the transporting path of the wrapping sheet onto the wrapping sheet is provided.

* * * * *